US010378803B2

(12) United States Patent
Uchaykin

(10) Patent No.: US 10,378,803 B2
(45) Date of Patent: Aug. 13, 2019

(54) SYSTEMS AND METHODS FOR ELECTROSTATIC TRAPPING OF CONTAMINANTS IN CRYOGENIC REFRIGERATION SYSTEMS

(71) Applicant: D-Wave Systems Inc., Burnaby (CA)

(72) Inventor: Sergey Uchaykin, Vancouver (CA)

(73) Assignee: D-WAVE SYSTEMS INC., Burnaby (CA)

( * ) Notice: Subject to any disclaimer, the term of this patent is extended or adjusted under 35 U.S.C. 154(b) by 285 days.

(21) Appl. No.: 15/502,165

(22) PCT Filed: Aug. 5, 2015

(86) PCT No.: PCT/US2015/043857
§ 371 (c)(1),
(2) Date: Feb. 6, 2017

(87) PCT Pub. No.: WO2016/022718
PCT Pub. Date: Feb. 11, 2016

(65) Prior Publication Data

US 2017/0227267 A1 Aug. 10, 2017

Related U.S. Application Data

(60) Provisional application No. 62/035,072, filed on Aug. 8, 2014.

(51) Int. Cl.
*B03C 3/41* (2006.01)
*F25B 43/00* (2006.01)
(Continued)

(52) U.S. Cl.
CPC ..... *F25B 43/00* (2013.01); *B03C 3/41* (2013.01); *B03C 3/45* (2013.01); *F25B 9/145* (2013.01); *B03C 2201/06* (2013.01)

(58) Field of Classification Search
CPC . F25B 43/00; F25B 9/145; B03C 3/45; B03C 3/41; B03C 2201/06
See application file for complete search history.

(56) References Cited

U.S. PATENT DOCUMENTS 2,982,106 A 5/1961 Ambler
3,195,322 A 7/1965 London
(Continued)

FOREIGN PATENT DOCUMENTS

FR 2 914 050 A1 9/2008
GB 1025385 A 4/1966
(Continued)

OTHER PUBLICATIONS

International Search Report, dated Oct. 27, 2015, for International Application No. PCT/US2015/043857, 3 pages.
(Continued)

*Primary Examiner* — Ana M Vazquez
(74) *Attorney, Agent, or Firm* — Cozen O'Connor

(57) ABSTRACT

Systems and methods for improving the performance of dilution refrigeration systems are described. Electrostatic cryogenic cold traps employed in the helium circuit of a dilution refrigerator improve the removal efficiency of contaminants from the helium circuit. An ionization source ionizes at least a portion of a refrigerant that includes helium and number of contaminants. The ionized refrigerant passes through an electrostatic cryogenic cold trap that includes a number of surfaces at one or more temperatures along at least a portion of the fluid passage between the cold trap inlet and the cold trap outlet. A high voltage source coupled to the surfaces to causes a first plurality of surfaces to function as electrodes at a first potential and a second plurality of surfaces to function as electrodes at a second potential. As
(Continued)

ionized contaminants release their charge on the electrodes, the contaminants bond to the electrodes.

26 Claims, 2 Drawing Sheets

(51) Int. Cl.
*F25B 9/14* (2006.01)
*B03C 3/45* (2006.01)

(56) References Cited

U.S. PATENT DOCUMENTS

| | | | |
|---|---|---|---|
| 3,340,699 | A | 9/1967 | Post, Jr. et al. |
| 3,376,712 | A | 4/1968 | London |
| 3,415,069 | A | 12/1968 | Hauser |
| 3,788,096 | A | 1/1974 | Brilloit |
| 3,854,913 | A | 12/1974 | Leyarovski et al. |
| 4,366,676 | A | 1/1983 | Wheatley et al. |
| 4,400,183 | A | 8/1983 | Henrich et al. |
| 4,506,513 | A | 3/1985 | Max |
| 4,679,402 | A | 7/1987 | Andeen |
| 4,770,006 | A | 9/1988 | Roach et al. |
| 4,771,823 | A | 9/1988 | Chan |
| 4,907,413 | A | 3/1990 | Clarkson et al. |
| 4,986,077 | A | 1/1991 | Saho et al. |
| 5,172,554 | A | 12/1992 | Swift et al. |
| 5,450,729 | A | 9/1995 | Hilton |
| 5,611,208 | A | 3/1997 | Hemmerich et al. |
| 5,671,612 | A | 9/1997 | Menzenski |
| 5,780,314 | A | 7/1998 | Chan |
| 5,956,957 | A | 9/1999 | Lowry et al. |
| 6,332,925 | B1 | 12/2001 | Noji et al. |
| 6,378,312 | B1 | 4/2002 | Wang |
| 6,383,257 | B1 | 5/2002 | McDermott et al. |
| 6,629,417 | B2 | 10/2003 | Haas et al. |
| 6,651,653 | B1 | 11/2003 | Honkonen et al. |
| 6,803,599 | B2 | 10/2004 | Amin et al. |
| 7,162,877 | B2 | 1/2007 | Daniels |
| 7,323,963 | B2 | 1/2008 | Nemoto et al. |
| 7,533,068 | B2 | 5/2009 | Maassen van den Brink et al. |
| 7,619,437 | B2 | 11/2009 | Thom et al. |
| 8,464,542 | B2 | 6/2013 | Hilton et al. |
| 9,134,047 | B2 | 9/2015 | Black et al. |
| 9,234,691 | B2 | 1/2016 | Black et al. |
| 9,528,744 | B2 | 12/2016 | Frossati |
| 2003/0024250 | A1 | 2/2003 | Haas et al. |
| 2004/0011074 | A1 | 1/2004 | Sano et al. |
| 2004/0089017 | A1 | 5/2004 | Mikheev et al. |
| 2005/0051420 | A1 | 3/2005 | Botvinnik et al. |
| 2005/0086974 | A1 | 4/2005 | Steinbach et al. |
| 2006/0097146 | A1 | 5/2006 | Strobel |
| 2006/0248618 | A1 | 11/2006 | Berkley |
| 2007/0107445 | A1 | 5/2007 | Boesel et al. |
| 2008/0176750 | A1 | 7/2008 | Rose et al. |
| 2008/0238531 | A1 | 10/2008 | Harris |
| 2009/0102580 | A1 | 4/2009 | Uchaykin |
| 2009/0121215 | A1 | 5/2009 | Choi |
| 2010/0157552 | A1 | 6/2010 | Thom et al. |
| 2010/0281885 | A1 | 11/2010 | Black et al. |
| 2011/0219785 | A1 | 9/2011 | Black et al. |
| 2011/0283737 | A1 | 11/2011 | Alvord et al. |
| 2012/0135867 | A1 | 5/2012 | Thom et al. |
| 2013/0231249 | A1 | 9/2013 | Black et al. |
| 2014/0137571 | A1 | 5/2014 | Petroff et al. |
| 2014/0326001 | A1 | 11/2014 | Citver et al. |
| 2015/0153427 | A1 * | 6/2015 | Garside ..... F25B 9/00 324/318 |

FOREIGN PATENT DOCUMENTS

| | | | |
|---|---|---|---|
| GB | 2493553 | B | 9/2017 |
| WO | 2010/002884 | A2 | 1/2010 |
| WO | 2013/190263 | A1 | 12/2013 |
| WO | 2015/041726 | A1 | 3/2015 |
| WO | 2015/163703 | A1 | 10/2015 |
| WO | 2016/005463 | A1 | 1/2016 |

OTHER PUBLICATIONS

Pobell, *Matter and Methods at Low Temperatures*, Springer-Verlag, Germany, 1996, Chapter 7, "The $^3$He—$^4$He Dilution Refrigerator," pp. 120-156. (39 pages).
Written Opinion of the International Searching Authority, dated Oct. 27, 2015, for International Application No. PCT/US2015/043857, 15 pages.
Black et al., "Systems, Methods, and Apparatus for Cryogenic Cycle Refrigeration," U.S. Appl. No. 61/017,460, filed Dec. 28, 2007, 85 pages.
Black et al., "Systems, Methods, and Apparatus for Cryogenic Refrigeration," Office Action dated Oct. 3, 2012, for U.S. Appl. No. 12/811,067, 14 pages.
Black et al., "Systems, Methods, and Apparatus for Cryogenic Refrigeration," Amendment filed Nov. 30, 2012, for U.S. Appl. No. 12/811,067, 10 pages.
Burger et al., "165 K Microcooler Operating with a Sorption Compressor and a Micromachined Cold Stage," *Cryocoolers 11*:551-560, 2001.
Citver et al., "Systems and Methods for Cryogenic Refrigeration," U.S. Appl. No. 61/881,313, filed Sep. 23, 2013, 29 pages.
Craig et al., "Hitchhiker's Guide to the Dilution Refrigerator," Version 2.00, Marcus Lab, Harvard University, revised Aug. 21, 2004, 20 pages.
Devlin et al., "A high capacity completely closed-cycle 250 mK $^3$He refrigeration system based on a pulse tube cooler," *Cryogenics 44*:611-616, 2004.
Extended European Search Report, dated Oct. 4, 2016, for European Application No. 13856929.8-1602 / 2923160, 7 pages.
International Search Report and Written Opinion, dated Feb. 24, 2014, for International Application No. PCT/US2013/071226, 9 pages.
International Search Report and Written Opinion, dated Aug. 17, 2009, for International Application No. PCT/US2008/088245, 8 pages.
International Search Report and Written Opinion, dated Aug. 25, 2014, for International Application No. PCT/US2014/039002, 9 pages.
Maibaum et al., "Systems, Devices, and Methods for Analog Processing," U.S. Appl. No. 61/039,710, filed Mar. 26, 2008, 48 pages.
Petroff et al., "Systems and Methods for Cryogenic Refrigeration," U.S. Appl. No. 61/729,250, filed Nov. 21, 2012, 17 pages.
Petroff et al., "Systems and Methods for Cryogenic Refrigeration," U.S. Appl. No. 61/736,456, filed Dec. 12, 2012, 22 pages.
Qiu et al., "Performance improvement of a pulse tube cooler below 4 K by use of $GdAlO_3$ regenerator material," *Cryogenics 41*:693-696, 2001.
Sivokon et al., "Operating features of a dilution refrigerator with condensation pumping," *Low Temp. Phys. 19*(4):312-316, 1993.
Thom et al., "Input/Output System and Devices for Use With Superconducting Devices," U.S. Appl. No. 61/080,996, filed Jul. 15, 2008, 81 pages.
Uchaykin et al., "Systems, Methods, and Apparatus for Cryogenic Refrigeration," U.S. Appl. No. 61/083,439, filed Jul. 24, 2008, 31 pages.
Uchaykin et al., "Systems, Methods, and Apparatus for Cryogenic Refrigeration," U.S. Appl. No. 61/086,432, filed Aug. 5, 2008, 31 pages.

* cited by examiner

SYSTEMS AND METHODS FOR ELECTROSTATIC TRAPPING OF CONTAMINANTS IN CRYOGENIC REFRIGERATION SYSTEMS

BACKGROUND

Field

The present systems and methods generally relate to cryogenic refrigeration technology.

Refrigeration

Temperature is a property that can have a great impact on the state and evolution of a physical system. For instance, environments of extreme heat can cause even the strongest and most solid materials to melt away or disperse as gas. Likewise, a system that is cooled to cryogenic temperatures may enter into a regime where physical properties and behavior differ substantially from what is observed at room temperature. In many technologies, it can be advantageous to operate in this cryogenic regime and harness the physical behaviors that are realized at low temperatures. The various embodiments of the systems, methods and apparatus described herein may be used to provide and maintain the cryogenic environments necessary to take advantage of the physics at cold temperatures.

Throughout this specification and the appended claims, the term "cryogenic" is used to refer to the temperature range of 0 Kelvin (K) to about 93K. A variety of technologies may be implemented to produce an environment with cryogenic temperature, though a commonly used device that is known in the art is the helium-3-helium-4 dilution refrigerator, known as, a dilution refrigerator. Dilution refrigerators achieve extreme cryogenic temperatures below 50 mK. In the operation of a typical dilution refrigerator, the apparatus itself requires a background temperature of about 4K. In order to provide this background cooling, the apparatus may be, e.g., immersed in an evaporating bath of liquid helium-4 ($^4$He) or, e.g., coupled to another type of refrigeration device, such as a pulse-tube cryocooler. The dilution refrigerator apparatus may comprise a series of heat exchangers and chambers that allow the temperature to be lowered further to a point where a mixture of helium-3 ($^3$He) and $^4$He separates into two distinct phases. In the first phase is mostly $^3$He, known as the concentrated phase, and in the second phase is mostly $^4$He with some $^3$He, known as the dilute phase. The dilution refrigerator apparatus is configured to allow some of the $^3$He to move from the concentrated phase into the dilute phase in an endothermic process analogous to evaporation, providing cooling and allowing a temperature of around 10 mK to be achieved. The $^3$He is drawn out of the dilute phase mixture to through a counterflow heat exchanger, condensed, cooled, returned to the concentrated phase portion of the mixture via the counterflow heat exchanger to define a helium circuit. Even though the dilute phase is $^4$He rich the $^3$He is preferentially drawn from the dilute phase because $^3$He has a higher partial pressure than $^4$He. Further details on this dilution effect and the operation of typical dilution refrigerators may be found in F. Pobell, *Matter and Methods at Low Temperatures*, Springer-Verlag, Second Edition, 1996, pp. 120-156.

In most dilution refrigerator designs, mechanical pumps and compressors, and an external gas-handling system, are used to circulate $^3$He such that it is warmed from the lowest temperature in the fridge up above cryogenic temperatures and towards room temperature before it is returned to the low temperature. The pumps and compressors used are large, expensive, noisy, in need of periodic maintenance, and they inevitably add contaminants, such as air (i.e., nitrogen, oxygen, carbon dioxide, argon, etc.) to the helium. These contaminants typically have higher freezing points than the helium and so may solidify in the helium fluid channels, creating blockages. Such blockages may plug fine capillaries in the dilution refrigerator, causing problems with reliability. Plugging often requires a complete warm-up of a dilution refrigerator in order to remove the contaminants and restore the fridge to normal operations. The procedure of warming and subsequently cooling back down to operating temperatures can take several days. Filters and cold traps can be used to reduce the frequency of plugging by removing contaminants from the helium, but current filters and traps are of limited effectiveness. Thus, plugging due to contaminants, such as, nitrogen, oxygen, carbon dioxide, and argon remains a serious technical challenge in cryogenic refrigeration technology affecting refrigeration system performance and availability.

BRIEF SUMMARY

Cryogenic cold traps preferentially remove contaminants from cryogenic refrigeration systems. Such cryogenic cold traps typically operate at temperatures, a range of temperatures, or a temperature gradient at which contaminants such as nitrogen, oxygen, carbon dioxide, argon that may be present in the cryogenic refrigerant are cryocondensed or cryoadsorbed on surfaces within the cold trap. The condensed or adsorbed contaminants are periodically flushed from the cooler by removing the cold trap from service and raising the temperature of the cold trap to a level where the contaminants flash off the surfaces within the cold trap. One or more cold sources (e.g., one or more pulse tube cryocoolers) may be used to maintain the temperature of the surfaces within the cold trap at any desired level. In one example, the surfaces in a cold trap may be maintained at a defined temperature gradient such that contaminants are preferentially cryocondensed or cryoadsorbed on surfaces positioned in different temperature regions, zones, or locations within the cold trap.

Cryocondensing cold traps remove contaminants from a refrigerant when the contaminants bond (or "freeze") to the surfaces in the cold trap. Thus, increasing the surface area available for bonding within a cryocondensing cold trap tends to improve the contaminant removal efficiency of the trap. Consequently, plates, meshes, and other shapes having a large quantity of surface area per unit volume are typically used within cryocondensing cold traps.

Electric fields are formed between two surfaces when a first potential is applied to the first surface and a second potential that is different than the first potential is applied to a second surface. Where such first and second surfaces exist within a cryocondensing cold trap, electric fields may be created within the cold trap. The presence of these electric fields within such an electrostatic cryocondensing cold trap may advantageously improve the contaminant removal efficiency of the trap, particularly when the refrigerant flowing through the trap is directed through the electric fields and across or around the first and second surfaces.

Ionizing at least a portion of the refrigerant and entrained contaminants upstream of ab electrostatic cryocondensing cold trap further improves the contaminant removal efficiency of an electrostatic cryocondensing cold trap. The combination of ionized contaminants and first and second cold trap surfaces maintained at different potentials advantageously causes the contaminants to covalently bond to the surfaces. The ionized contaminants that covalently bond to the surfaces release any charge carried by the molecule to the surface, however the low temperature of the surface retains the contaminant molecule via cryocondensation or cryoadsorption. In contrast, when the surfaces are maintained in a range of from about 2K to about 60K, any ionized refrigerant (e.g., ionized $^3$He and/or $^4$He) captured by the surfaces is released after the charge carried by the refrigerant is released to the surface.

Any of a number of ionizing sources may be used to ionize some or all of the refrigerant and at least a portion of the contaminants carried by the refrigerant. Ideally, the ionizing sources should contribute minimal heat to the refrigeration system. A corona discharge ionization source can be used to create an ion flux. An electron emitting filament may also be used as an ionization source. Unfortunately, when operating at production levels, both the corona discharge ionization source and the filament ionization source may provide an unacceptably high level of thermal output. A radioactive source of ionizing energy, for example americium-241 (a source of alpha-particles and low energy gamma rays) as found in many household smoke detectors, has been found to provide acceptable performance in ionizing the contaminants in a cryogenic refrigeration system while providing an acceptable level of thermal input to the refrigeration system.

Using nitrogen as an illustrative contaminant found in cryogenic refrigeration systems, the dipole drift in an electric field with a gradient of $10^9$ volts per meter (V/m) is found to have an acceleration of about $2.5\times10^{-5}$ meters per second squared (m/s$^2$). The London dispersion forces retaining the nitrogen molecule on the electrode surface in the cold trap is approximately 4.3 $\times10^{-2}$ electron volts (eV). At operating temperatures typically encountered in the cold trap, the kinetic energy of nitrogen molecules is approximately $1.3\times10^{-3}$ eV. Thus, once molecular nitrogen bonds to the electrode surface, the kinetic energy of any "free" molecular nitrogen present in the cryogenic refrigerant is insufficient to displace the nitrogen molecules bonded to the electrode surface.

An example electrostatic cold trap should be conductively coupleable to a high voltage source to produce an electric field having a strong electric field gradient between the electrode/surfaces in the cold trap. The electrode/surfaces in the trap may be further refined to enhance one or more aspects of the electric field. For example, the electrode/surfaces may be in the form of blades having tapered edges that at least partially extend into a conduit defining the cryogenic refrigerant flow path. In another example, the electrode surfaces may be in the form of pins, needles, or blades, having tapered shape that at least partially extend into a conduit defining the cryogenic refrigerant flow path. An electrode with tapered shape provides for a greater gradient in an associated electric field.

A method of operating an electrostatic cryogenic cold trap may be summarized as including: providing a refrigerant that includes one or more contaminants along a fluid passage that extends from at least one inlet to at least one outlet of the electrostatic cryogenic cold trap; adjusting a temperature along the fluid passage to provide a defined temperature, a defined temperature range, or a defined temperature gradient along the fluid passage through the electrostatic cryogenic cold trap; causing at least some of the one or more contaminants present in the refrigerant to electrostatically bond to a plurality of collection electrodes by: forming a first electrical potential of a first polarity on a plurality of discharge electrodes positioned in the fluid passage that extends from the at least one inlet to the at least one outlet of the electrostatic cryogenic cold trap; forming a second electrical potential of a second polarity on the plurality of collection electrodes, the second polarity opposite the first polarity, and the plurality of collection electrodes positioned in the fluid passage that extends from the at least one inlet to the at least one outlet of the electrostatic cryogenic cold trap.

Applying a suitable temperature, a range of temperatures, or a temperature gradient to the fluid passage that extends from the at least one inlet to the at least one outlet of the electrostatic cryogenic cold trap may include: thermally conductively coupling a number of cold sources, each at a respective temperature to a respective portion of the fluid passage. Forming a first electrical potential of a first polarity on a plurality of discharge electrodes positioned in the fluid passage that extends from the at least one inlet to the at least one outlet of the electrostatic cryogenic cold trap may include: forming a first electrical potential of a first polarity on a plurality of discharge electrodes in the form of needle-shaped discharge electrodes that project at least partially into the fluid passage that extends from the at least one inlet to the at least one outlet of the electrostatic cryogenic cold trap. Forming a second electrical potential of a second polarity on the plurality of collection electrodes, the second polarity opposite the first polarity, and the plurality of collection electrodes positioned in the fluid passage that extends from the at least one inlet to the at least one outlet of the electrostatic cryogenic cold trap may include: forming a second electrical potential of a second polarity on the plurality of collection electrodes, the second polarity opposite the first polarity, and the plurality of collection electrodes in the form of needle-shaped collection electrodes that project at least partially into the fluid passage that extends from the at least one inlet to the at least one outlet of the electrostatic cryogenic cold trap. Forming a first electrical potential of a first polarity on a plurality of discharge electrodes positioned in the fluid passage that extends from the at least one inlet to the at least one outlet of the electrostatic cryogenic cold trap may include: forming a first electrical potential of a first polarity on a plurality of discharge electrodes in the form of tapered, blade-shaped, discharge electrodes that project at least partially into the fluid passage that extends from the at least one inlet to the at least one outlet of the electrostatic cryogenic cold trap. Forming a second electrical potential of a second polarity on the plurality of collection electrodes, the second polarity opposite the first polarity, and the plurality of collection electrodes positioned in the fluid passage that extends from the at least one inlet to the at least one outlet of the electrostatic cryogenic cold trap may include: forming a second electrical potential of a second polarity on the plurality of collection electrodes, the second polarity opposite the first polarity, and the plurality of collection electrodes in the form of tapered, blade-shaped, collection electrodes that project at least partially into the fluid passage that extends from the at least one inlet to the at least one outlet of the electrostatic cryogenic cold trap. The method of operating an electrostatic cryogenic cold trap may further include: interspersing each of at least some of the plurality of discharge electrodes at the first electrical potential with each of at least some of the plurality of collection electrodes at the second electrical potential; wherein flowing a refrigerant that includes one or more contaminants along a fluid passage that extends from at least one inlet to at least one outlet of the electrostatic cryogenic cold trap includes: flowing the refrigerant that includes the one or more contaminants along a fluid passage through at least one electric field formed by interspersing each of at least some of the plurality of discharge electrodes at the first electrical potential with each of at least some of the plurality of collection electrodes at the second electrical potential. The method of operating an electrostatic cryogenic cold trap may further include: interleaving, in a parallel arrangement, each of at least some of the plurality of discharge electrodes at the first electrical potential with each of at least some of the plurality of collection electrodes at the second electrical potential; wherein the interleaved discharge electrodes and collection electrodes form a serpentine fluid passage that extends from at least one inlet to at least one outlet of the electrostatic cryogenic cold trap; and wherein flowing a refrigerant that includes one or more contaminants along the fluid passage that extends from at least one inlet to at least one outlet of the electrostatic cryogenic cold trap includes flowing at least a portion of the refrigerant that includes the one or more contaminants along the serpentine fluid passage formed by the interleaved discharge electrodes and collection electrodes. The method of operating an electrostatic cryogenic cold trap may further include: ionizing at least a portion of the one or more contaminants present in the refrigerant prior to flowing the refrigerant and ionized contaminants along the fluid passage that extends from the at least one inlet to the at least one outlet of the electrostatic cryogenic cold trap. Applying a temperature gradient to the fluid passage that extends from the at least one inlet to the at least one outlet of the electrostatic cryogenic cold trap may include: applying at least one of an increasing or a decreasing temperature gradient between 6K and 40K to the fluid passage. Applying a temperature gradient to the fluid passage that extends from the at least one inlet to the at least one outlet of the electrostatic cryogenic cold trap may include: applying at least one of an increasing or a decreasing temperature gradient between 4K and 50K to the fluid passage. Applying a temperature gradient to the fluid passage that extends from the at least one inlet to the at least one outlet of the electrostatic cryogenic cold trap may include: applying at least one of an increasing temperature gradient and a decreasing temperature gradient to the fluid passage such that a ratio of the temperature gradient along the fluid passage is greater than about 10:1. Ionizing at least a portion of the one or more contaminants present in the refrigerant may include: ionizing at least a portion of the one or more contaminants present in the refrigerant using at least one of: a corona discharge source of ionizing energy or electrons emitted from a heated filament. Ionizing at least a portion of the one or more contaminants present in the refrigerant may include: ionizing at least a portion of the one or more contaminants present in the refrigerant using a radioactive source. Ionizing at least a portion of the one or more contaminants present in the refrigerant using a radioactive source may include: ionizing at least a portion of the one or more contaminants present in the refrigerant using the radioactive source. Examples of a radioactive source include americium-241 in a gold matrix as a source of alpha particles and gamma rays, or cobalt-60 a source of beta particles and gamma rays.

An electrostatic cryogenic cold trap may be summarized as including: a housing having at least one inlet and at least one outlet and at least one fluid passage that extends between the at least one inlet and the at least one outlet, wherein in use the housing adjusts a temperature of a refrigerant present in the at least one fluid passage that extends from the at least one inlet to the at least one outlet; a plurality of discharge electrodes positioned in the at least one fluid passage that extends from the at least one inlet to the at least one outlet; a plurality of collection electrodes positioned in the at least one fluid passage that extends from the at least one inlet to the at least one outlet; and at least one voltage source electrically coupled to apply an electrical potential of a first polarity to the discharge electrodes, and to apply an electrical potential of a second polarity, opposite to the first polarity, to the collection electrodes.

The plurality of discharge electrodes may take the form of a plurality of needles that extend into the fluid passage. The plurality of collection electrodes may take the form of a plurality of needles that extend into the fluid passage. At least some of the collection electrodes may be interspersed with at least some of the discharge electrodes in the fluid passage. At least some of the collection electrodes may be parallel and interleaved with at least some of the discharge electrodes to form a serpentine portion of the fluid passage that extends between a first one of the discharge electrodes and a last one of the collection electrodes in the fluid passage. The electrostatic cryogenic cold trap may further include: a number of cold sources, each of the number of cold sources at a respective temperature, and each of the number of cold sources thermally conductively coupled to a respective portion of the housing along the fluid passage. The respective temperature of the cold sources may be progressively lower as the fluid passage is traversed from the at least one inlet toward the at least one outlet. A temperature proximate the at least one inlet may be above about 40K and a temperature proximate the at least one outlet may be below about 6K. A temperature proximate the at least one inlet may be about 50 Kelvin and a temperature proximate the at least one outlet may be equal to or below about 4K. A ratio of the temperature gradient along the fluid passage (inlet to outlet or outlet to inlet) may be more than approximately 10:1. The electrostatic cryogenic cold trap may further include: an ionizing energy source operatively coupled to the at least one inlet connection, the ionizing energy source to ionize at least a portion of a cryogenic refrigerant flowing through the at least one inlet connection. The ionizing energy source may include at least one of a corona discharge source of ionizing energy or a filament that upon heating emits electrons as a source of ionizing energy. The ionizing energy source may include a radioactive source. The radioactive source may include americium-241 or cobalt-60.

An electrostatic cold trap system may be summarized as including: an electrostatic cold trap comprising: a housing having at least one inlet and at least one outlet and at least one fluid passage that extends between the at least one inlet and the at least one outlet; a plurality of tapered, blade-shaped, discharge electrodes that extend at least partially into the at least one fluid passage that extends from the at least one inlet to the at least one outlet; and a plurality of tapered, blade-shaped, collection electrodes that extend at least partially into the at least one fluid passage that extends from the at least one inlet to the at least one outlet; wherein at least a some of the plurality of tapered, blade-shaped, collection electrodes are positioned relative to the plurality of tapered, blade-shaped, discharge electrodes such that at least a portion of the at least one fluid passage includes a channel bounded at least in part by the respective discharge electrodes and the respective collection electrodes; a number of cold sources thermally conductively coupled to the housing, that in operation, create a temperature gradient along at least a portion of the at least one fluid passage in fluid contact with at least that extends from the at least one inlet to the at least one outlet; at least one voltage source electrically coupled to each of the discharge electrodes and to each of the collection electrodes such that, in operation, applies an electrical potential of a first polarity to the discharge electrodes and an electrical potential of a second polarity, opposite to the first polarity, to the collection electrodes; and at least one ionizing energy source operatively coupled to the at least one inlet connection, the ionizing energy source to ionize at least a portion of a cryogenic refrigerant flowing through the at least one inlet.

BRIEF DESCRIPTION OF THE SEVERAL VIEWS OF THE DRAWING(S)

In the drawings, identical reference numbers identify similar elements or acts. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn are not intended to convey any information regarding the actual shape of the particular elements, and have been solely selected for ease of recognition in the drawings.

DETAILED DESCRIPTION

Figure 1:
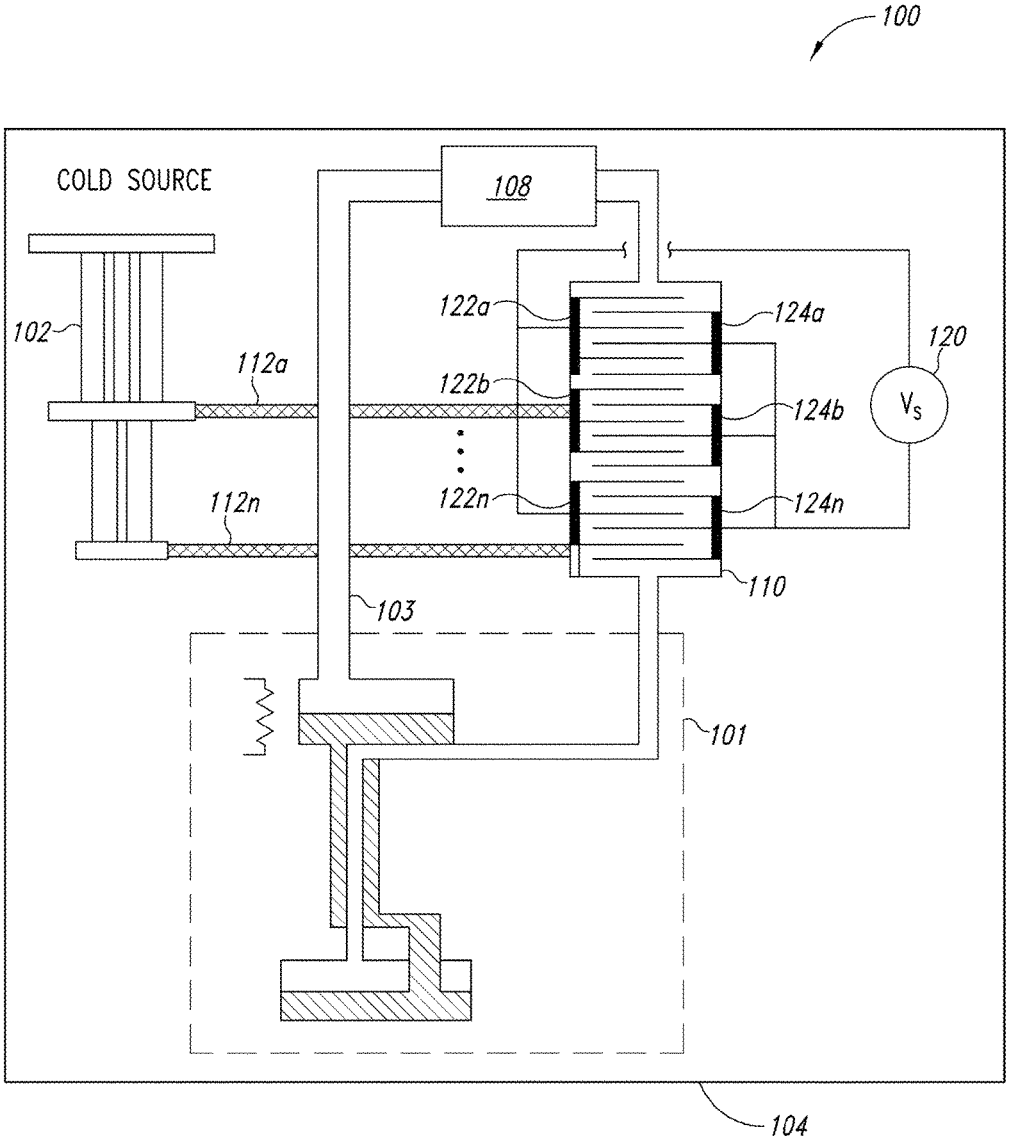
FIG. 1 is a schematic diagram of an exemplary dilution refrigeration system employing an electrostatic cold trap design, according to one embodiment.

In the following description, some specific details are included to provide a thorough understanding of various disclosed embodiments. One skilled in the relevant art, however, will recognize that embodiments may be practiced without one or more of these specific details, or with other methods, components, materials, etc. In other instances, well-known structures associated with refrigeration systems, such as heat exchangers, impedances, and control systems including microprocessors, heat switches, drive circuitry and nontransitory computer- or processor-readable media such as nonvolatile memory for instance read only memory (ROM), electronically erasable programmable ROM (EEPROM) or FLASH memory, etc., or volatile memory for instance static or dynamic random access memory (ROM) have not been shown or described in detail to avoid unnecessarily obscuring descriptions of the embodiments of the present systems and methods.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment," or "an embodiment," or "another embodiment" means that a particular referent feature, structure, or characteristic described in connection with the embodiment is included in at least one embodiment. Thus, the appearances of the phrases "in one embodiment," or "in an embodiment," or "another embodiment" in various places throughout this specification are not necessarily all referring to the same embodiment. Furthermore, the particular features, structures, or characteristics may be combined in any suitable manner in one or more embodiments.

It should be noted that, as used in this specification and the appended claims, the singular forms "a," "an," and "the" include plural referents unless the content clearly dictates otherwise. Thus, for example, reference to a problem-solving system including "a refrigeration system" includes a single refrigeration system, or two or more refrigeration systems. It should also be noted that the term "or" is generally employed in its sense including "and/or" unless the content clearly dictates otherwise.

The headings and Abstract provided herein are for convenience only and do not interpret the scope or meaning of the embodiments.

The various embodiments described herein provide systems and methods for improving the performance of cryogenic refrigeration systems. More specifically, the various embodiments described herein provide systems and methods for improved filtering/trapping of contaminants in the helium circuit of a dilution refrigerator.

Most dilution refrigeration systems available today are susceptible to plugging in the helium circuit caused by the crystallization, solidification, or "freezing" of contaminants carried by the helium refrigerant. For example, a small leak in a pump or portion of tubing in the helium circuit may allow the ingress of air into the helium circuit, and the components contained in the air (e.g., oxygen, nitrogen, water, carbon dioxide, and argon) may freeze at a temperature at which the helium remains a gas or liquid. Such crystallized or frozen components may adhere to the inner walls of the tubing that forms the helium circuit, increasing pressure drop within the circuit, limiting refrigerant flow within the circuit and ultimately, plugging the circuit. Such plugging will affect, and may completely disrupt, the operation of the dilution refrigerator.

In some applications, it may be desirable for a dilution refrigerator to be capable of continuous operations for extended periods. For example, in applications of superconducting computing (such as superconducting quantum computing) where the computer processor is cooled using a dilution refrigerator, it may be desirable for the computer processor to remain cold (i.e., operational) for years at a time. Current dilution refrigeration systems will typically experience a plugging event at greater frequencies (i.e., on the order of days, weeks, or months) and are therefore unsuitable for providing long-term continuous availability and operation. Current dilution refrigeration systems rely on filters or "cold traps" to remove contaminants from the helium in the helium circuit.

Most cold traps available today employ cryoadsorption that "soak up" or adsorb contaminants from the helium refrigerant as it flows through the cold trap. Systems and methods for cryoadsorptive cold trapping are known in the art and would be understood by a person of skill in the art. In brief, a cryoadsorptive cold trap comprises a large volume (i.e., the "trap") having an input port and an output port. The cryoadsorptive cold trap operates in series with the helium refrigeration circuit. The trap is cooled to a cryogenic temperature, typically by immersion in a cryogenic liquid such as liquid nitrogen or thermally anchored to a pulse tube cryocooler. One or more cryoadsorptive materials, such as charcoal, activated charcoal, or zeolite at least partially fills the cryoadsorptive cold trap. When the cryoadsorptive material is cooled to a sufficiently low temperature (by thermal coupling to, e.g., the liquid cryogen bath; "sufficiently cold" depends on the specific material being employed and the contaminants being adsorbed from the helium refrigerant) the cryoadsorptive material will adsorb certain substances from the helium refrigerant as the refrigerant passes through the cryoadsorptive cold trap. In essence, the cryoadsorptive material be analogized to a "sponge" that selectively adsorbs or "soaks up" constituents of the helium refrigerant while permitting the passage of other constituents. Whether a given constituent is "soaked up" or "passes through" the cryoadsorptive material depends, at least in part, on the temperature and/or composition of the cryoadsorptive material. Any significant adsorption of helium occurs only at very low temperatures (i.e., lower than most other constituents present in the helium refrigerant), thus, a cryoadsorptive material may be cooled to a temperature at which it does not adsorb helium itself but does adsorb other constituents, such as one or more contaminants present in the helium refrigerant. This is the basis for most modern cryoadsorptive cold traps.

There are many potential sources of performance degradation in cryoadsorptive cold traps. For example, to maintain a low temperature, the liquid nitrogen used in the cooling bath surrounding the cryoadsorptive cold trap continually boils away a small quantity of nitrogen. As nitrogen boils off, the changing liquid level in the cooling bath may cause undesirable fluctuations in cryoadsorptive cold trap temperature. These changes in temperature, though small, can adversely affect the performance and/or efficiency of the cryoadsorptive cold trap. Thus, cryoadsorptive cold traps cooled in a nitrogen bath frequently require regular replenishment of liquid nitrogen to maintain stable bath level and temperature conditions.

Furthermore, many cryoadsorptive materials (such as charcoal) are very poor thermal conductors and not easily cooled to the temperature of the liquid nitrogen bath. Thus, even after immersion of the cryoadsorptive cold trap in a liquid nitrogen bath, no guarantee exists that the cryoadsorptive material within the trap is at a temperature optimal for providing a desired contaminant trapping efficiency. Furthermore, cryoadsorptive cold traps respond poorly to phase changes of contaminants therein. Solidification of contaminants on the surface of the cryoadsorptive material can influence the flow of helium through the trap and can provide "low resistance channels" through which contaminants pass.

A further limitation of modern dilution refrigerator/adsorption trap designs is that the "sponging" type mechanism by which they operate results in the inevitable saturation of the adsorptive material with adsorbed contaminants. When such contaminant saturation occurs, the cryoadsorptive cold trap ceases to remove further contaminants from the helium. In extreme instances, after saturating the cryoadsorptive material in the cryoadsorptive cold trap, contaminants may accumulate within the refrigeration circuit to levels sufficient to compromise the operability of the refrigeration circuit. Consequently, the efficiency of adsorption degrades as the volume of contaminants adsorbed increases.

Most adsorption traps typically seen in the art employ a single mass of adsorption material contained in a large reservoir volume. This inevitably results in the formation of preferential flow paths (i.e., "channels" or "rat-holes") through the cryoadsorptive material such that the helium refrigerant flowing through the cryoadsorptive cold trap contacts only a fraction of the adsorptive surface of the cryoadsorptive material.

Cryocondensation is a physical phenomenon whereby molecules in a first phase (e.g., liquid or gas) encounter a very cold surface and undergo a phase change (e.g., to a solid) and, in the process, bond (i.e., "freeze") to the underlying cold surface. When unwanted cryocondensation occurs in a refrigeration circuit, the contaminant buildup can detrimentally block or plug the refrigeration circuit, compromising the effectiveness or efficiency of the refrigeration system (as described above).

A cryocondensation trap may be similar to a cryoadsorption trap in that it employs an inner volume connected in series with the helium circuit via an input port and an output port. However, the inner volume of a cryocondensation trap includes a cryocondensation material having extended surface area maintained at very low temperatures using cold sources thermally conductively coupled to the cryocondensation trap. The cryocondensation material within the cryocondensation trap may take the form of numerous plates, flutes, corrugations, or other similar shapes offering relatively high surface area to volume ratios. Alternatively, the cryocondensation material within the cryocondensation trap may take the form of a sintered metal, a screen, a mesh, a wool, or other "perforated" formation that presents a large wetted surface area to the helium refrigerant flowing through the trap. Ideally, the cryocondensation material will have a binding energy that matches one or more of the contaminants present in the helium refrigerant but does not match helium, thereby minimizing the trapping of helium within the cryocondensation material. The internal extended surface area within the cryocondensation trap are frequently fabricated from a material having a high thermal conductivity (to promote rapid and even temperature distribution across the condensation surfaces in the cryocondensation trap) and a high specific heat, such as a metal (e.g., copper, stainless steel, silver sinter, brass, bronze, aluminum, etc.) or other material, such as alumina silicate, clay, glass wool, etc. The residency of molecules on the cryocondensation material should be long, for example, months or even years.

As described previously, certain contaminants may cryocondense and/or cryoadsorb at a first temperature range and other contaminants may cryocondense and/or cryoadsorb at a second temperature range that may or may not overlap all or a portion of the first temperature range. For example, water, carbon dioxide, and many hydrocarbons cryocondense/cryoadsorb at around 77K, however nitrogen, oxygen, and argon cryoadsorb/cryocondense at around 20K. Thus, in accordance with the present systems and methods, it may be advantageous to implement a cryocondensing cold trap operating a temperature gradient such that contaminants having higher cryocondensation temperatures (e.g., water) cryocondense on cryocondensation material maintained at a higher temperature (e.g., 77K) located near the inlet of the cold trap while contaminants having lower cryocondensation temperatures (e.g., nitrogen) cryocondense on cryocondensation material maintained at a lower temperature (e.g. 20K) located near the outlet of the cold trap.

Thus, a single cryocondensation cold trap operating at a range of different temperatures may trap many different contaminants present in the helium refrigerant including water, carbon dioxide, hydrocarbons, nitrogen, oxygen, argon, etc. In general, a trap that is designed to trap a large number/volume of contaminants must employ a correspondingly large trapping volume to prevent becoming plugged. Furthermore, some contaminants such as neon and hydrogen may cryoadsorb/cryocondense at or below about 5K. Thus, in accordance with the present systems and methods, it may be advantageous to implement a cold trap that is capable of trapping impurities at range of temperatures such as at or below 77K, at or below 20K and at or below 5K. Particular care must be taken for a cold trap operating at about 5K to minimize trapping of helium.

In accordance with the present systems and methods, the cold trap may be cooled to an operational temperature by thermally conductively coupling a cryocondensing cold trap to one or more cold sources such that during operation, the cryocondensing cold trap is maintained at one or more define temperatures or one or more defined temperature ranges. The cryocondensing cold trap may further include a heat exchanger in order to establish a temperature gradient in the cold trap thereby providing for the trapping of a number of contaminants in different regions of the same cold trap. Alternatively, the cold trap may be thermally conductively coupled to any number of different temperature stages of a cold source thereby providing a number of different temperature regions within the cold trap, thereby forming a temperature gradient within the cryocondensing cold trap.

In accordance with the present systems and methods, the performance of a cryocondensing cold trap may be unexpectedly and advantageously improved by electrically conductively coupling a voltage source to a plurality of discharge electrodes at least partially extending into the fluid passage that carries refrigerant through the cryocondensing cold trap and maintains the discharge electrodes at a first potential. The voltage source is electrically conductively coupled to a plurality of collection electrodes at least partially extending into the fluid passage that carries refrigerant through the cryocondensing cold trap and maintains the collection electrodes at a second potential. The electric field produced by the discharge electrodes and collection electrodes in such an electrostatic cryocondensing cold trap has been found to beneficially improve the contaminant removal performance of the trap.

In accordance with the present systems and methods, the performance of an electrostatic cryocondensing cold trap may be unexpectedly and advantageously improved by ionizing at least a portion of the helium refrigerant including some or all of the contaminants present in the refrigerant at a point in the refrigeration circuit upstream of the electrostatic cryocondensing cold trap. The electric field produced in the electrostatic cryocondensing material promotes the movement of ionized helium and contaminant molecules in the helium refrigerant to the electrode surface. Upon contacting the electrode surface, ionized helium releases the charge to the electrode and releases back into the helium refrigerant. In contrast, when ionized contaminants contact the electrode surface, the ionizing charge is released to the electrode and the contaminants covalently bond (i.e., are frozen) to the electrode surface. By ionizing at least a portion of the helium refrigerant and passing the at least partially ionized refrigerant through an electrostatic cryocondensing cold trap in which the cryocondensing surfaces are maintained at potentials sufficient to create an electric field through which at least a portion of the helium refrigerant flows, the removal efficiency of such an electrostatic cryocondensing cold trap is further enhanced.

FIG. 1 is a schematic diagram of an exemplary dilution refrigeration system 100 employing an electrostatic cryocondensing cold trap 110 in accordance with the present systems and methods. The dilution refrigeration system 100 includes dilution refrigerator 101, which is background cooled by a cold source such as a pulse tube cryocooler 102. The cold head of the pulse tube cryocooler 102 thermally conductively couples to a condensation portion of the dilution refrigerator 101 (not shown in the Figure to reduce clutter). Dilution refrigeration system 100 also includes refrigerant circuit 103 (comprising fluid channels and tubing for refrigerant flow) that passes through an electrostatic cryocondensation trap 110. The electrostatic cryocondensing cold trap 110 is thermally conductively coupled to one or more (two shown in FIG. 1) stages of the pulse tube cryocooler 102. Although only a single pulse tube cryocooler 102 is depicted in FIG. 1, additional cryocoolers 102 may be used. Although only the pulse tube cryocooler 102 depicted in FIG. 1 is of a two stage type a different cryocooler with more stages may be used. Additionally, while the electrostatic cryocondensing cold trap 110 is depicted as thermally conductively coupled to two pulse tube cryocooler stages, a lesser or greater number of cryocooler stages may be thermally conductively coupled to the electrostatic cryocondensing cold trap 110.

As illustrated, the refrigeration circuit 103 includes an optional ionizing source 108 capable of ionizing at least a portion of the refrigerant and contaminants circulating through the refrigeration loop 103 and passing through or proximate the ionizing source 108. Portions of the cryocondensation material or structures in the electrostatic cryocondensation trap 110 are electrically conductively coupled to a voltage source 120 to provide a plurality of discharge electrodes 122*a*-122*n* (collectively "discharge electrodes 122"). The voltage source 120 maintains the plurality of discharge electrodes 122 at a first potential. Other portions of the cryocondensation material or structures in the electrostatic cryocondensation trap 110 are electrically conductively coupled to the voltage source 120 to provide a plurality of collection electrodes 124*a*-124*n* (collectively "collection electrodes 124"). The voltage source 120 maintains the plurality of collection electrodes 124 at a second potential that is different than the first potential. The terms "discharge electrode" and "collection electrode" are relative, not absolute terms. Thus, where a time-invariant voltage source 120 is used, the discharge electrodes may remain at the first potential and the collection electrodes may remain at the second potential while the voltage source is operating. In contrast, where a time-varying voltage source 120 (e.g., an alternating current voltage source) is used, a number of electrodes or groups of electrodes may be maintained at the first potential for a first, repeating, period of time (i.e., function as discharge electrodes) and may be maintained at the second potential for a second, repeating, period of time that alternates with the first period of time (i.e., function as collection electrodes).

The plurality of discharge electrodes 122 and the plurality of collection electrodes 124 may be disposed in any physical arrangement within the electrostatic cryocondensing cold trap 110. For example, each of the plurality of discharge electrodes 122 may be interspersed or alternated with each of the plurality collection electrodes 124. Further, the plurality of discharge electrodes 122 may be equally or unequally apportioned into any number of discharge electrode groups, each of which includes one or more discharge electrodes 122. Further, the plurality of collection electrodes 124 may be equally or unequally apportioned into any number of collection electrode groups, each of which includes one or more collection electrodes 122.

In operation, the different potentials between the plurality of discharge electrodes 122 and the plurality of collection electrodes 124 creates an electric field within the electrostatic cryocondensing cold trap 110. At times, the fluid passage along which at least a portion of the refrigerant passing through the electrostatic cryocondensing cold trap 110 flows causes the refrigerant to flow transversely or in parallel through such electric fields. The presence of the electric fields in the electrostatic cryocondensing cold trap 110 have been found to advantageously affect the ability of the electrostatic cryocondensing cold trap 110 to cryocondense contaminants on the surfaces of the discharge electrodes 122 and/or the collection electrodes 124. The electric fields within the electrostatic cryocondensing cold trap 110 preferentially facilitate the movement of contaminants carried by the refrigerant to the surface of the discharge electrodes 122 and/or the collection electrodes 124.

The electrostatic cryocondensation trap 110 may be thermally conductively coupled to any number of pulse tube cryocooler 102 stages. At times, each of such pulse tube cryocooler stages may be at different temperatures. By maintaining the electrostatic cryocondensing cold trap 110, and in particular the surfaces of the discharge electrodes 122 and/or the collection electrodes 124 at a particular temperature or within a particular temperature range, contaminants present in the refrigerant may be selectively cryocondensed at various locations along the fluid passage through the electrostatic cryocondensing cold trap 110.

In some implementations, the flow path through the electrostatic cryocondensation trap 110, including some or all of the surfaces of the discharge electrodes 122 and/or some or all of the surfaces of the collection electrodes 124 may be maintained at a defined temperature, for example 2K or greater, 3K or greater, 4K or greater, 5K or greater, 10K or greater, 20K or greater, 50K or greater, or 70K or greater. In some implementations, the flow path through the electrostatic cryocondensation trap 110, including some or all of the surfaces of the discharge electrodes 122 and/or some or all of the surfaces of the collection electrodes 124 may be maintained within a defined temperature range, for example between 2K and 100K, between 3K and 70K, between 3K and 50K, or between 3K and 30K.

In some implementations, the flow path through the electrostatic cryocondensation trap 110, including some or all of the surfaces of the discharge electrodes 122 and/or some or all of the surfaces of the collection electrodes 124 may be maintained at a defined increasing or decreasing temperature gradient. In one example an electrostatic cryocondensation trap 110 having an evenly or unevenly increasing temperature gradient with a beginning temperature of about 2K, 3K, 4K, 5K, 7K, or 10K and an ending temperature of about 20K, 30K, 40K, 50K, 60K, 70K, 80K, 90K, or 100K. In another example an electrostatic cryocondensation trap 110 having an evenly or unevenly decreasing temperature gradients with a beginning temperature of about 20K, 30K, 40K, 50K, 60K, 70K, 80K, 90K, or 100K and an ending temperature of about 2K, 3K, 4K, 5K, 7K, or 10K. For example, the cryocooler 102 maintains the electrostatic cryocondensing cold trap 110 at a defined single temperature sufficiently low to cause the contaminants present in the refrigerant to cryocondense on the surfaces of the discharge electrodes 122 and the collection electrodes 124 yet sufficiently high to minimize the cryocondensation of the refrigerant on the surfaces of the electrodes. In another example, the cryocooler 102 maintains the electrostatic cryocondensing cold trap 110 at a defined temperature gradient that causes the contaminants in the refrigerant to cryocondense on the surfaces of the discharge electrodes 122 and the collection electrodes 124 in different temperature thermal regions along the fluid passage through the electrostatic cryocondensing cold trap 110 and minimizes the cryocondensation of the refrigerant on the surfaces of the electrodes.

The voltage source 120 can include any number of sources of electromotive force capable of maintaining the plurality of discharge electrodes 122 at a first potential and the plurality of collection electrodes 124 at a second potential. The different in potential causes an electric field to form between the plurality of discharge electrodes 122 and the plurality of collection electrodes 124. At times, the voltage source 120 may include one or more voltage sources that maintain the discharge electrodes 122 at a time-invariant first potential and maintain the collection electrodes 124 at a time-invariant second potential. At times, the voltage source 120 may include one or more voltage sources that provide a time varying voltage to the plurality of discharge electrodes 122 and the plurality of collection electrodes 124.

For example, the voltage source 120 may include an alternating current source capable of providing a time varying sinusoidal voltage to the plurality of discharge electrodes 122 and the plurality of collection electrodes 124. In such an implementation, a first group of electrodes will vary between the first potential and the second potential and a second group of electrodes will vary between the second potential and the first potential in opposition to the first group of electrodes. Thus, the designation of the plurality of discharge electrodes 122 and the plurality of collection electrodes 124 may change or vary over time. Such time variant electrode functionality may beneficially serve to equalize the distribution of contaminants on the electrodes within the electrostatic cryocondensing cold trap 110, thereby extending the service life of the electrostatic cryocondensing cold trap 110.

The optional ionizing source 108 provides an energy input to the refrigerant flowing through the refrigerant circuit 103 sufficient to at least partially ionize at least a portion of the refrigerant and some or all of the contaminants carried by the refrigerant prior to introducing the refrigerant to the electrostatic cryocondensing cold trap 110. The ionizing source 108 can include any system or device capable of providing sufficient energy to ionize at least a portion of the refrigerant. The ionization energy of helium is 24.6 electron volts (eV). The ionization energy of various contaminants found in cryogenic refrigerants includes oxygen (12.6 electron volts (eV)); nitrogen (15.6 eV); hydrogen (15.4 eV); carbon dioxide (13.8 eV); methane (12.6 eV); and argon (15.8 eV). The ionizing source 108 should therefore provide ionizing energy of greater than 16 eV to ionize the contaminants present in a helium refrigerant or a helium-based refrigerant.

An illustrative ionizing source 108 includes a corona discharge ionization source. Another illustrative ionizing source 108 includes an electron emitting filament ionization source. At operational levels, the ionizing source 108 should provide minimal heat input to the refrigeration circuit. Both corona discharge and filament ionizing sources provide rather substantial heat inputs to the refrigeration circuit. Yet another illustrative ionizing source 108 includes a radioactive ionization source such as americium-241 in a gold matrix (half-life of about 432 years) that emits ionizing alpha particles and low energy gamma rays while providing minimal heat input to the refrigeration circuit. Another example of radioactive ionization source is cobalt-60 that emits beta particles and gamma rays (half-life of about 1925 days). The at least partially ionized refrigerant exits the ionizing source 108 and enters the electrostatic cryocondensing cold trap 110.

The at least partially ionized refrigerant entering the electrostatic cryocondensation cold trap 110 can be at a temperature in excess of about 100K, for example the temperature of an at least partially ionized helium refrigerant may be at a temperature of approximately 300K upon entering the electrostatic cryocondensing cold trap 110. The temperature of the at least partially ionized refrigerant decreases as the refrigerant progresses through the electrostatic cryocondensation trap 110. The electric fields within the electrostatic cryocondensing cold trap 110 cause the ionized molecules in the at least partially ionized refrigerant to migrate towards the surface of the collection electrodes 124. Additionally, the decrease in temperature as the at least partially ionized refrigerant flows through the electrostatic cryocondensing cold trap 110 causes the selective cryocondensation of contaminants on the collection electrodes 124 positioned along the length of the fluid passage through the electrostatic cryocondensing cold trap 110.

In some instances, the voltage source 120 maintains a constant electric field along the fluid passage through the electrostatic cryocondensing cold trap 110. In other instances, the voltage source 120 maintains a varying electric field throughout all or a portion of the fluid passage through the electrostatic cryocondensing cold trap 110. For example, in one implementation, the voltage source 120 maintains a constant electric field strength of approximately 300 Volts per centimeter (V/cm) along the length of the fluid passage through the electrostatic cryocondensing cold trap 110. In another example implementation, the voltage source 120 provides an increasing strength electric field (e.g., 300 V/cm to 500 V/cm) or a decreasing strength electric field (e.g., 500 V/cm to 300 V/cm) along the length of the fluid passage through the electrostatic cryocondensing cold trap 110.

The combination of an at least partially ionized refrigerant, a temperature gradient along the length of the fluid passage through the electrostatic cryocondensing cold trap 110, and a constant or variable electric field within the electrostatic cryocondensing cold trap 110 advantageously permits "tailoring" of the electrostatic cryocondensing cold trap 110 to specific contaminants present in the refrigerant. Additionally, conditions within the electrostatic cryocondensing cold trap 110 may be adjusted such that helium is preferentially released from the collection electrodes 124 after releasing the ionizing charge while contaminants such as water, carbon dioxide, nitrogen, oxygen, and argon remain bonded (or "frozen") to the collection electrodes 124 after releasing the ionizing charge.

Using nitrogen as an example contaminant that may be present in a helium refrigerant, the force exerted on the ionized nitrogen molecule by an electric field having a gradient of approximately $10^9$ (i.e., the electric field produced by the discharge electrodes 122 and the collection electrodes 124) causes the ionized nitrogen molecules to drift with an acceleration of approximately $2.5\times10^{-3}$ meters per second squared ($m/s^2$). The kinetic energy carried by an ionized nitrogen molecule having an acceleration of $2.5\times10^{-3}$ $m/s^2$ is approximately $1.3\times10^{-3}$ eV. The electrostatic forces retaining ionized nitrogen molecules on the surface of an electrode (e.g., a collection electrode 124 maintained at an appropriate temperature) are principally London dispersion forces having a strength of approximately $4.3\times10^{-2}$ eV, an order of magnitude larger than the kinetic energy of the ionized nitrogen molecules in the helium refrigerant. Thus, once bonded to the electrode surface, the nitrogen molecules are unlikely to be displaced back into solution due to interaction between neighboring molecules via Van der Waals forces.

The discharge electrodes 122 and collection electrodes 124 within the electrostatic cryocondensing cold trap 110 provide an extended surface area capable of supporting a high contaminant load within the refrigerant. The discharge electrodes 122 and the collection electrodes 124 can have similar or different physical shapes or geometries. In another example implementation, the discharge electrodes 122 and the collection electrodes 124 can take the form of plates with or without tapered edges that are alternated throughout the length of the fluid passage through the electrostatic cryocondensing cold trap 110 so as to provide a serpentine fluid passage that causes the at least partially ionized refrigerant to pass between successive pairs of discharge and collection electrodes. In another example implementation, the discharge electrodes 122 and the collection electrodes 124 can take the form of blades, needles, or pins or other shapes having a taper with or without sharp tips that project into and are alternated throughout the length of the fluid passage through the electrostatic cryocondensing cold trap 110 so as to provide a serpentine fluid passage that causes the at least partially ionized refrigerant to pass across and/or between successive pairs of discharge and collection electrodes. Although two illustrative electrode configurations are provided, many other electrode configurations and/or geometries are possible, for example loop electrodes positioned about all or a portion of the circumference of the fluid passage through the electrostatic cryocondensing cold trap 110. Additionally, different electrode configurations may be combined within a single electrostatic cryocondensing cold trap 110. For example, a single electrostatic cryocondensing cold trap 110 may be divided into a number of sections, each containing a different number or type of discharge and/or collection electrode. In such an implementation, some or all of the sections may be operated at similar or different temperatures, increasing or decreasing temperature gradients, and constant or variable electrical fields.

In some implementations, it may be desirable to couple multiple cold traps in a series, parallel, or series/parallel arrangement to provide the ability to remove cold traps from the refrigeration loop 103 for maintenance or contaminant removal procedures. Two or more types of cold traps may be used in a single refrigeration circuit 103. For example, two cryoadsorptive cold traps in parallel followed by two cryocondensing cold traps 110 in parallel. Such arrangements provide operational redundancy and flexibility for maintenance and regeneration of the electrostatic cryocondensing cold traps 110.

The dilution refrigeration system 100 also includes a vacuum can 104 that may contain some or all of the dilution refrigerator 101, the pulse tube cryocooler 102, and the electrostatic cryocondensation cold trap 110. Since the electrostatic cryocondensing cold trap 110 is contained within the vacuum can 104 that houses dilution refrigerator 101, the electrostatic cryocondensing cold trap 110 may be referred to as an "internal cold trap" in dilution refrigeration system 100.

Figure 2:
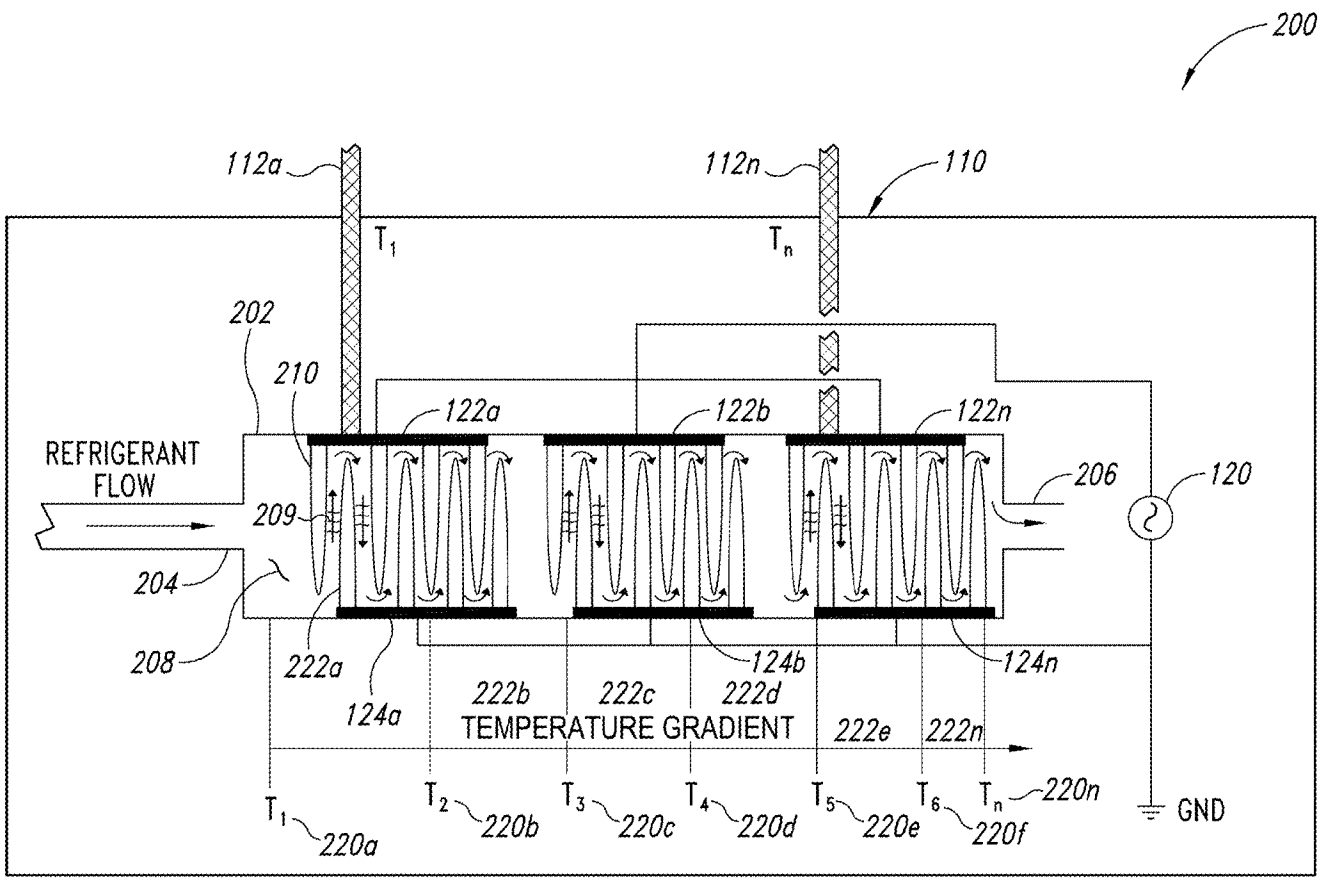
FIG. 2 is a schematic diagram of an electrostatic cryogenic cold trap system, according to one embodiment.

FIG. 2 is a schematic diagram of an electrostatic cryocondensing cold trap 110 in accordance with the present systems and methods. The electrostatic cryocondensing cold trap 110 includes a housing 202 having at least one inlet 204 and at least one outlet 206. A fluid passage 208 extends within the housing from the at least one inlet 204 to the at least one outlet 206. A number of electrodes 210, at least some of which project at least partially into the fluid passage 208, are disposed within the housing 202. The electrodes 210 are electrically conductively coupled to the voltage source 120 to provide a plurality of discharge electrodes 122 and a plurality of collection electrodes 124. Although the discharge electrodes 122 and the collection electrodes 124 are shown apportioned into three groups in FIG. 2, apportionment into any number of electrode groups is possible. The discharge electrodes 122 and the collection electrodes 124 may be positioned or disposed within the housing 202 in such a manner to define a serpentine fluid passage 208 through the housing 202.

Maintaining the discharge electrodes 122 and the collection electrodes at different potentials during operation causes an electric field 209 to form between the discharge electrodes 122 and the collection electrodes 124. When the fluid passage 208 through the electrostatic cryocondensing cold trap 110 follows a serpentine or serpentine path between at least some of the discharge electrodes 122 and the collection electrodes 124 (i.e., through electric field 209), the contaminant removal efficiency of the electrostatic cryocondensing cold trap 110 improved remarkably. Thus, at times, the discharge electrodes 122 and the collection electrodes 124 may be positioned or otherwise disposed within the housing 202 such that the fluid passage 208 causes at least a portion of a refrigerant introduced via the at least one inlet 204 to flow through such electric fields 209.

The electrostatic cryocondensing cold trap 110 may be thermally conductively coupled to one or more cold sources, for example one or more pulse tube cryocoolers 102. At times, one or more such cold sources can maintain the electrostatic cryocondensing cold trap 110 at a defined temperature selected, at least in part, on the actual or expected contaminants present in the refrigerant. At other times, the cold sources can maintain the electrostatic cryocondensing cold trap 110 at a defined temperature gradient. The temperature gradient is defined by an inlet temperature 220*a* ($T_1$) at the at least one inlet 204 to an outlet temperature 220*n* ($T_n$) at the at least one outlet 206. A decreasing temperature gradient along the fluid passage 208 results when the inlet temperature 220*a* is greater than the outlet temperature 220*n*. An increasing temperature gradient along the fluid passage 208 results when the inlet temperature 220*a* is less than the outlet temperature 220*n*. In some examples, the increasing temperature gradient includes arranging the inlet 204 in the helium circuit to receive refrigerant from the dilution refrigerator 101. In some examples, the decreasing temperature gradient includes arranging the inlet 204 and the associated trap 100 in the helium circuit to receive refrigerant from a higher temperature stage in dilution refrigeration system. For example, the refrigerant could be returned from a low temperature stage to higher temperature stage, such as, liquid helium temperature stage, and then passing the refrigerant through a fluid passage with a decreasing temperature gradient.

Where cold sources maintain a temperature gradient along the fluid passage 208 through the electrostatic cryocondensing cold trap 110, a number of different temperature regions 222*a*-222*n* (collectively, "thermal regions 222") are equally or unequally distributed along the fluid passage 208. As the refrigerant flows along the fluid passage 208 through the different thermal regions 222, contaminants having a cryocondensation temperature that falls within the respective thermal region 222 will cryocondense and bond to the surface of at least some of the electrodes 210 within the respective thermal region 222.

For example, to provide a decreasing temperature gradient through the electrostatic cryocondensing cold trap 110, the thermal region 222*a* proximate the at least one inlet 204 of the electrostatic cryocondensing cold trap 110 may be maintained at a temperature of about 70K or less, about 60K or less, or about 50K or less. In contrast, the thermal region 222*n* proximate the at least one outlet 206, may be maintained at a temperature of about 10K or less; about 7K or less; or about 5K or less. In some implementations, the ratio of the temperature gradient (i.e., a ratio of the high temperature to low temperature) is greater than about 2:1; greater than about 4:1; greater than about 5:1; greater than about 8:1; greater than about 10:1; or greater than about 20:1.

In one implementation, a number of cold sources 102 provide a decreasing thermal gradient in which the thermal region 222*a* proximate the at least one inlet 204 is maintained at approximately 70K and the thermal region 222*n* proximate the at least one outlet 206 is maintained at approximately 5K. Using such an electrostatic cryocondensing cold trap 110, contaminants such as water will bond to the surface of electrodes 210 disposed in the first thermal region 222*a* while contaminants such as nitrogen and oxygen will not. On the other hand, using such an electrostatic cryocondensing cold trap 110 contaminants such as oxygen and nitrogen will bond to the surface of electrodes 210 in the last thermal region 222*n*. The electrodes 210 in the intervening thermal regions between the first thermal region 222*a* and the last thermal region 222*n* are maintained at decreasing temperatures between about 70K and about 5K to selectively cryocondense contaminants having cryocondensation temperatures between 5K and 70K.

As discussed above, at times, all or a portion of the refrigerant may pass through one or more ionizing sources 108 prior to entering the electrostatic cryocondensing cold trap 110.

The electrostatic cryocondensing cold trap 110 replaces a portion of tubing in a dilution refrigeration system 100. Typically, the refrigerant circuit uses small diameter tubing and blockages may result when only small quantities of contaminants cryocondense within the tubing. The electrostatic cryocondensing cold trap 110 replaces at least a portion of the narrow tubing in the refrigeration circuit with the larger diameter housing 202 that is at least partially filled with electrodes 210 that provide significant cryocondensation surface area.

Tubing 230 may comprise a metal such as stainless steel. A region of tubing 230 may be thermalized to one specific temperature along with heat exchanger 250 to transfer cold gas, or be thermalized to multiple temperatures by thermal coupling tubing 230 to different temperature stages of pulse tube 240 to establish a temperature gradient over the trapping surface. Providing trapping surfaces at multiple temperatures (or over a gradient of temperatures) may help ensure multiple contaminant material are trapped. The combination of increased volume in tubing 230 and added condensation surfaces (221-226) within the tubing may be designed to have a low net effect on the impedance of this tubing section in the fridge.

As shown in FIG. 2, the electrostatic cryocondensing cold trap 110 is thermally conductively coupled to one or more a cryocooler stages (not shown in FIG. 2) via tubing 112*a*-112*n*. The cryocooler can maintain a portion of the electrostatic cryocondensing cold trap 110 proximate the one or more inlets 204 at a first temperature $T_1$, for example 70K. The cryocooler can maintain a portion of the electrostatic cryocondensing cold trap 110 proximate the one or more outlets 206 at a second temperature $T_n$, for example less than 6K, or for instance at or below approximately 5K. This causes a temperature gradient throughout the electrostatic cryocondensing cold trap 110 and the electrode surfaces within the electrostatic cryocondensing cold trap 110 approach the temperature of the refrigerant flowing along the fluid passage 208 at different points along the fluid passage 208 through the electrostatic cryocondensing cold trap 110.

At approximately 77K, contaminants such as $H_2O$, $CO_2$ and most hydrocarbons may cryocondense on the surfaces of the electrodes 210 in the thermal region(s) 222 of the electrostatic cryocondensing cold trap 110 maintained at or below approximately 77K. Similarly, at approximately 20K, contaminants such as $N_2$, oxygen and argon may cryocondense on the surfaces of the electrodes 210 in the thermal region(s) 222 of the electrostatic cryocondensing cold trap 110 maintained at or below approximately 20K. At approximately 5K, contaminants such as Ne and $H_2$ may cryocondense on the surfaces of the electrodes 210 in the thermal region(s) 222 of the electrostatic cryocondensing cold trap 110 maintained at or below approximately 5K. Thus, contaminants having higher cryocondensation temperatures (such as $H_2O$) that escape trapping on the surfaces of the electrodes 210 in the thermal region(s) 222 of the electrostatic cryocondensing cold trap 110 maintained at or below approximately 77K are likely to cryocondense in subsequent thermal regions 222 that are maintained at even lower temperatures. One can appreciate that selected contaminants, particularly those contaminants having cryocondensation temperatures greater than the temperature maintained within the thermal region 222*n* proximate the one or more outlets 206 have little or no chance of escaping the electrostatic cryocondensing cold trap 110 and returning to the refrigeration circuit 103.

As previously described, it may be advantageous to increase the surface area of the cryocondensation surfaces (i.e., the electrode surfaces) within the electrostatic cryocondensing cold trap 110 to increase the potential contaminant loading capacity of the electrostatic cryocondensing cold trap 110. In some instances, the surface area of some or all of the electrodes 210 in the electrostatic cryocondensing cold trap 110 using fins, corrugations, or other features that increase the available electrode surface area. In some instances, the surface of some or all of the electrodes 210 in the electrostatic cryocondensing cold trap 110 may incorporate guides, vanes, or similar flow-directing or flow-enhancing surface features to improve one or more refrigerant flow characteristics (e.g., direction, velocity, contact time) over the surface of the electrode. In some instances, some or all of the electrodes 210 may include features to alter, adjust, or enhance the electric fields produced by the electrodes. For example, in some instances, the edges of some or all of the electrodes may be tapered.

The above description of illustrated embodiments, including what is described in the Abstract, is not intended to be exhaustive or to limit the embodiments to the precise forms disclosed. Although specific embodiments of and examples are described herein for illustrative purposes, various equivalent modifications can be made without departing from the spirit and scope of the disclosure, as will be recognized by those skilled in the relevant art. The teachings provided herein of the various embodiments can be applied to other methods of quantum computation, not necessarily the exemplary methods for quantum computation generally described above.

The various embodiments described above can be combined to provide further embodiments. All of the U.S. patents, U.S. patent application publications, U.S. patent applications, International (PCT) patent applications referred to in this specification and/or listed in the Application Data Sheet including U.S. Provisional Application No. 62/035,072, filed Aug. 8, 2014, are incorporated herein by reference, in their entirety. Aspects of the embodiments can be modified, if necessary, to employ systems, circuits and concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A method of operating an electrostatic cryogenic cold trap, the method comprising:

providing a refrigerant that includes one or more contaminants to a fluid passage that extends from at least one inlet to at least one outlet of the electrostatic cryogenic cold trap, at least a portion of the fluid passage held at one or more temperatures;

causing at least some of the one or more contaminants present in the refrigerant to electrostatically bond to a plurality of collection electrodes by:

forming a first electrical potential of a first polarity on a plurality of discharge electrodes positioned in the fluid passage that extends from the at least one inlet to the at least one outlet of the electrostatic cryogenic cold trap;

forming a second electrical potential of a second polarity on the plurality of collection electrodes, the second polarity opposite the first polarity, and the plurality of collection electrodes positioned in the fluid passage that extends from the at least one inlet to the at least one outlet of the electrostatic cryogenic cold trap;

selecting a first contaminant of the one or more contaminants, the first contaminant comprising a plurality of molecules; and selecting a value of each of the first electrical potential, the second electrical potential, and at least one of the one or more temperatures, to cause electrostatic bonding of a first molecule of the plurality of molecules to at least one of the plurality of collection electrodes, wherein the energy of the electrostatic bonding of the first molecule is greater than an average molecular kinetic energy of the plurality of molecules.

2. The method of operating an electrostatic cryogenic cold trap of claim 1 wherein providing the refrigerant that includes one or more contaminants to the fluid passage, at least the portion of the fluid passage held at one or more temperatures comprises:

providing the refrigerant that includes one or more contaminants to the fluid passage, at least the portion of the fluid passage held at one or more temperatures via a thermally conductively coupled pulse-tube cryocooler.

3. The method of operating an electrostatic cryogenic cold trap of claim 1 wherein forming the first electrical potential of the first polarity on the plurality of discharge electrodes positioned in the fluid passage that extends from the at least one inlet to the at least one outlet of the electrostatic cryogenic cold trap comprises:

forming a first electrical potential of a first polarity on a plurality of discharge electrodes in the form of needle-shaped discharge electrodes that project at least partially into the fluid passage that extends from the at least one inlet to the at least one outlet of the electrostatic cryogenic cold trap.

4. The method of operating an electrostatic cryogenic cold trap of claim 1 wherein forming the second electrical potential of the second polarity on the plurality of collection electrodes, the second polarity opposite the first polarity, and the plurality of collection electrodes positioned in the fluid passage that extends from the at least one inlet to the at least one outlet of the electrostatic cryogenic cold trap comprises:

forming the second electrical potential of the second polarity on the plurality of collection electrodes, the second polarity opposite the first polarity, and the plurality of collection electrodes in the form of needle-shaped collection electrodes that project at least partially into the fluid passage that extends from the at least one inlet to the at least one outlet of the electrostatic cryogenic cold trap.

5. The method of operating an electrostatic cryogenic cold trap of claim 1 wherein forming the first electrical potential of the first polarity on the plurality of discharge electrodes positioned in the fluid passage that extends from the at least one inlet to the at least one outlet of the electrostatic cryogenic cold trap comprises:

forming a first electrical potential of a first polarity on a plurality of discharge electrodes in the form of tapered, blade-shaped, discharge electrodes that project at least partially into the fluid passage that extends from the at least one inlet to the at least one outlet of the electrostatic cryogenic cold trap.

6. The method of operating an electrostatic cryogenic cold trap of claim 1 wherein forming the second electrical potential of the second polarity on the plurality of collection electrodes, the second polarity opposite the first polarity, and the plurality of collection electrodes positioned in the fluid passage that extends from the at least one inlet to the at least one outlet of the electrostatic cryogenic cold trap comprises:

forming the second electrical potential of the second polarity on the plurality of collection electrodes, the second polarity opposite the first polarity, and the plurality of collection electrodes in the form of tapered, blade-shaped, collection electrodes that project at least partially into the fluid passage that extends from the at least one inlet to the at least one outlet of the electrostatic cryogenic cold trap.

7. The method of operating an electrostatic cryogenic cold trap of claim 1, further comprising:

interspersing each of at least some of the plurality of discharge electrodes at the first electrical potential with each of at least some of the plurality of collection electrodes at the second electrical potential;

wherein flowing the refrigerant that includes one or more contaminants along the fluid passage that extends from at least one inlet to at least one outlet of the electrostatic cryogenic cold trap includes:

flowing the refrigerant that includes the one or more contaminants along the fluid passage through at least one electric field formed by interspersing each of at least some of the plurality of discharge electrodes at the first electrical potential with each of at least some of the plurality of collection electrodes at the second electrical potential.

8. The method of operating an electrostatic cryogenic cold trap of claim 1, further comprising:

interleaving, in a parallel arrangement, each of at least some of the plurality of discharge electrodes at the first electrical potential with each of at least some of the plurality of collection electrodes at the second electrical potential;

wherein the interleaved discharge electrodes and collection electrodes form a serpentine fluid passage that extends from at least one inlet to at least one outlet of the electrostatic cryogenic cold trap; and wherein flowing the refrigerant that includes one or more contaminants along the fluid passage that extends from at least one inlet to at least one outlet of the electrostatic cryogenic cold trap includes flowing at least a portion of the refrigerant that includes the one or more contaminants along the serpentine fluid passage formed by the interleaved discharge electrodes and collection electrodes.

9. The method of operating an electrostatic cryogenic cold trap of claim 1, the method further comprising:

ionizing at least a portion of the one or more contaminants present in the refrigerant prior to flowing the refrigerant and ionized contaminants along the fluid passage that extends from the at least one inlet to the at least one outlet of the electrostatic cryogenic cold trap.

10. The method of operating an electrostatic cryogenic cold trap of claim 9 wherein providing the refrigerant that includes one or more contaminants to the fluid passage, at least the portion of the fluid passage held at one or more temperatures comprises:

applying a temperature gradient from the at least one inlet of the fluid passage to the at least one outlet of the fluid passage to provide at least one of: a decreasing temperature gradient having a ratio of a temperature measured at the at least one fluid inlet to a temperature measured at the at least one fluid outlet of at least 2:1; or an increasing temperature gradient having a ratio of the temperature measured at the at least one fluid outlet to the temperature measured at the at least one fluid inlet of at least 2:1.

11. The method of operating an electrostatic cryogenic cold trap of claim 9 wherein ionizing at least the portion of the one or more contaminants present in the refrigerant comprises:

ionizing at least a portion of the one or more contaminants present in the refrigerant using at least one of: a corona discharge source of ionizing energy or electrons emitted from a heated filament.

12. The method of operating an electrostatic cryogenic cold trap of claim 9 wherein ionizing at least the portion of the one or more contaminants present in the refrigerant comprises:

ionizing at least the portion of the one or more contaminants present in the refrigerant using a radioactive source.

13. The method of operating an electrostatic cryogenic cold trap of claim 1 wherein providing the refrigerant that includes one or more contaminants to the fluid passage, at least the portion of the fluid passage held at one or more temperatures comprises:

providing the refrigerant that includes one or more contaminants to the fluid passage, at least the portion of the fluid passage held within a defined temperature range.

14. The method of operating an electrostatic cryogenic cold trap of claim 1 wherein providing the refrigerant that includes one or more contaminants to the fluid passage, at least the portion of the fluid passage held at one or more temperatures comprises:

providing the refrigerant that includes one or more contaminants to the fluid passage, at least the portion of the fluid passage held at a defined increasing or decreasing temperature gradient.

15. An electrostatic cryogenic cold trap, comprising:

a housing having at least one inlet and at least one outlet and at least one fluid passage that extends between the at least one inlet and the at least one outlet, wherein in use the housing provides a thermally conductive path that adjusts a temperature of a refrigerant along at least a portion of the at least one fluid passage that extends from the at least one inlet to the at least one outlet, the refrigerant including a contaminant, the contaminant comprising a plurality of molecules;

a plurality of discharge electrodes positioned in the at least one fluid passage that extends from the at least one inlet to the at least one outlet;

a plurality of collection electrodes positioned in the at least one fluid passage that extends from the at least one inlet to the at least one outlet; and at least one voltage source electrically coupled to apply an electrical potential of a first polarity to the discharge electrodes, and to apply an electrical potential of a second polarity, opposite to the first polarity, to the collection electrodes, the electrical potential of the first polarity, the electrical potential of the second polarity, and the temperature of the refrigerant along at least a portion of the at least one fluid passage are selected to cause electrostatic bonding of a first molecule of the plurality of molecules to at least one of the plurality of collection electrodes, wherein the energy of the electrostatic bonding of the first molecule is greater than an average molecular kinetic energy of the plurality of molecules.

16. The electrostatic cryogenic cold trap of claim 15 wherein the plurality of discharge electrodes take the form of a plurality of needles that extend into the fluid passage.

17. The electrostatic cryogenic cold trap of claim 15 wherein the plurality of collection electrodes take the form of a plurality of needles that extend into the fluid passage.

18. The electrostatic cryogenic cold trap of claim 15 wherein at least some of the collection electrodes are interspersed with at least some of the discharge electrodes in the fluid passage.

19. The electrostatic cryogenic cold trap of claim 15 wherein at least some of the collection electrodes are parallel and interleaved with at least some of the discharge electrodes to form a serpentine portion of the fluid passage which extends between a first one of the discharge electrodes and a last one of the collection electrodes in the fluid passage.

20. The electrostatic cryogenic cold trap of claim 15, further comprising:

a number of cold sources, each of the number of cold sources at a respective temperature, and each of the number of cold sources thermally conductively coupled to a respective portion of the housing along the fluid passage, wherein the respective temperature of the cold sources are progressively lower as the fluid passage is traversed from the at least one inlet toward the at least one outlet.

21. The electrostatic cryogenic cold trap of claim 20 wherein a ratio of the decreasing temperature gradient along the fluid passage is more than 2:1.

22. The electrostatic cryogenic cold trap of claim 15, further comprising:

an ionizing energy source operatively coupled to the at least one inlet, the ionizing energy source to ionize at least a portion of a cryogenic refrigerant flowing through the at least one inlet.

23. The electrostatic cryogenic cold trap of claim 22 wherein the ionizing energy source comprises at least one of a corona discharge source of ionizing energy or a filament that upon heating emits electrons as a source of ionizing energy.

24. The electrostatic cryogenic cold trap of claim 22 wherein the ionizing energy source comprises a radioactive source.

25. The electrostatic cryogenic cold trap of claim 15 wherein, in use, the housing provides a thermally conductive path that holds the temperature of the refrigerant present in the at least one fluid passage to within a defined temperature range along at least a portion of the at least one fluid passage.

26. The electrostatic cryogenic cold trap of claim 15 wherein, in use, the housing provides a thermally conductive path that holds the temperature of the refrigerant present in the at least one fluid passage to at least one of a defined increasing temperature gradient and a defined decreasing temperature gradient along at least a portion of the at least one fluid passage.

* * * * *